United States Patent [19]

Izumi et al.

[11] Patent Number: 4,601,813

[45] **Date of Patent: * Jul. 22, 1986**

[54] PROCESS FOR PRODUCING OPTICALLY ANISOTROPIC CARBONACEOUS PITCH

[75] Inventors: Takayuki Izumi, Oi; Tsutomu Naito, Saitama; Masuo Shinya, Oi; Tomio Nomura, Higashi-Matsuyama, all of Japan

[73] Assignee: Toa Wenryo Kogyo Kabushiki Kaisha, Tokyo, Japan

[ * ] Notice: The portion of the term of this patent subsequent to Jun. 12, 2001 has been disclaimed.

[21] Appl. No.: 412,321

[22] Filed: Aug. 27, 1982

[30] Foreign Application Priority Data

Aug. 28, 1981 [JP] Japan ..... 56-135296

[51] Int. Cl.[4] ..... C01C 3/00; D01F 9/12; D01F 9/20

[52] U.S. Cl. ..... 208/22; 208/39; 208/44; 423/447.2; 423/447.4; 423/447.6

[58] Field of Search ..... 208/22, 44, 39; 423/447.2, 447.4, 447.6

[56] References Cited

U.S. PATENT DOCUMENTS

| | | | |
|---|---|---|---|
| 3,976,729 | 8/1976 | Lewis et al. | 423/447.8 |
| 4,026,788 | 5/1977 | McHenry | 208/39 |
| 4,032,430 | 6/1977 | Lewis | 423/447.1 |
| 4,209,500 | 1/1980 | Chwastiak | 208/22 |
| 4,243,512 | 1/1981 | Seo | 208/22 |
| 4,303,631 | 12/1981 | Lewis et al. | 208/44 |
| 4,454,019 | 6/1984 | Izumi et al. | 208/22 |
| 4,454,020 | 6/1985 | Izumi et al. | 208/22 |

*Primary Examiner*—Andrew H. Metz
*Assistant Examiner*—Helane Myers
*Attorney, Agent, or Firm*—Seidel, Gonda, Goldhammer & Abbott

[57] ABSTRACT

In a process for producing an optically anisotropic carbonaceous pitch having a low softening point for the production of carbon material a starting oil to be used is a tar-like substance which is a mixture of compounds not substantially containing chloroform insolubles but containing components having a boiling point of 540° C. or more as principal components and consisting principally of carbon and hydrogen. The tar-like substance has a content of n-heptane insolubles of up to 1 wt % and contains an aromatic oil fraction and a resin fraction as the principal components of n-heptane soluble components. The aromatic carbon fraction, fa, is at least 0.7, the number-average molecular weight is up to 1,000 and the maximum molecular weight is up to 2,000 for each of the aromatic oil and resin fractions.

23 Claims, No Drawings

PROCESS FOR PRODUCING OPTICALLY ANISOTROPIC CARBONACEOUS PITCH

BACKGROUND OF THE INVENTION

This invention relates to processes for producing optically anisotropic carbonaceous pitch which is suitable for the production of carbon materials containing carbon fibers having a high tensile strength and high elastic modulus and other carbon materials. More particularly, the present invention relates to optically anisotropic carbonaceous pitch having a low softening point which is substantially homogeneous and which can be obtained by thermal decomposition polycondensation or other treatments of a liquid hydrocarbon mixture having a specific composition and structure as the starting material for the production of optically anisotropic carbonaceous pitch suitable for the production of carbon fibers and other molding carbon materials to be used for a composite material having a light weight, high strength and high elastic modulus, and relates also to processes for producing such carbonaceous pitch.

As energy saving and resource saving have become a need of the times, a keen demand has arisen for an economical high-performance carbon fiber as the raw material of a composite material having a light weight, high strength and high elastic modulus that is necessary for airplanes, cars and the like, or for a molding carbon material having a high strength and high density that can be adapted for a wide range of applications by pressure molding. The present invention provides a process for producing optically anisotropic carbonaceous pitch which has a low softening point, is homogeneous and excellent in the molecular orientation, is suitable for the production of high-performance carbon fibers and molding carbon materials such as those described above and can be easily molded, e.g., by melt-spinning.

As disclosed in Japanese Patent Application No. 162972/1980 filed previously by the inventors of the present invention, the inventors have examined various optically anisotropic pitch compositions suitable for producing high-performance carbon fibers, and have found that the optically anisotropic pitch has a good molecular orientation in which a laminate layer structure of condensed polycyclic aromatic groups has developed but various pitches exist as a mixture in practice. The inventors have also found that among these pitches, one that is suitable for the production of a homogeneous carbon fiber having a low softening point has a specific chemical structure and composition. That is to say, in the optically anisotropic pitches, the composition, structure and molecular weight of component O, i.e., an n-heptane soluble component, and component A, i.e., an n-heptane insoluble and benzene soluble component, have been found extremely important. Speaking in further detail, the inventors of the present invention have found that a pitch composition containing specific amounts of components O and A can exist as the optically anisotropic pitch and it is an essential condition for an optically anisotropic pitch composition to properly adjust the balance of the components in order to practically produce a high-performance carbon material.

The inventors have found further that an optically anisotropic pitch for producing carbon materials having higher performance can be provided by stipulating a quinoline soluble component (hereinafter referred to as "component B") and a quinoline insoluble component (hereinafter referred to as "component C") as the remaining benzene insolubles other than the abovementioned components O and A.

The inventors have further examined in detail the individual characteristics of each component and the relation between the content of each component having such characteristics and the properties, homogeneity and molecular orientation of the pitch as a whole, and have found that it is important that each component should be contained in a specified range of contents and should have specified range of properties. The inventors have thus found that the constituents of an optically anisotropic pitch which has high molecular orientation, homogeneity and a low softening point necessary for the production of a high-performance carbon fiber and can be melt-spun stably at a low temperature must have properties, such as the C/H atomic ratio, fa, number average molecular weight, maximum molecular weight (molecular weight at a point integrated by 99% from the low molecular weight side) and minimum molecular weight (molecular weight at a point integrated by 99% from the high molecular weight side) as specified within the following ranges, respectively.

The component O has the C/H atomic ratio of at least about 1.3, fa of at least about 0.80, the number-average molecular weight of up to about 1,000 and the minimum molecular weight of at least about 150. Preferably, the C/H atomic ratio is about 1.3 to 1.6, fa is about 0.80 to about 0.95, the number-average molecular weight is about 250 to about 700 and the minimum molecular weight is at least about 150.

The component A has the C/H atomic ratio of at least about 1.4, fa of at least about 0.80, the number-average molecular weight of up to about 2,000 and the maximum molecular weight of up to about 10,000. Preferably, the C/H atomic ratio is about 1.4 to about 1.7, fa is about 0.80 to about 0.95, the number-average molecular weight is about 400 to about 1,000, and the maximum molecular weight is up to about 5,000.

A suitable content of each component is about 2% to about 20% (by weight) for component O and is about 15% to about 45% (by weight) for component A. The optimal range is about 5% to about 15% (by weight) for component O and about 15% to about 35% (by weight) for component A.

If the C/H atomic ratio and fa of component O are below the abovementioned range and the content of component O is above the abovementioned range, the resulting pitch is likely to be heterogeneous as a whole and to contain a considerably great proportion of isotropic portions. If the average molecular weight is greater than 700 or if the content is below the abovementioned range, pitch having a low softening point can not be obtained. If the C/H atomic ratio or fa of component A is below the abovementioned range and if the number-average molecular weight is below the abovementioned range or the content exceeds the abovementioned range, the pitch is likely to become heterogeneous in which isotropic and anisotropic portions are mixed with each other. If the number-average molecular weight or the maximum molecular weight exceeds the abovementioned range or if the proportion of component A is below the abovementioned range, the resulting pitch will not have a low softening point, though it is homogeneous and optically anisotropic.

The inventors have furthered their studies and have found that components O and A are those which are entrapped in the laminate structure inside the optically anisotropic pitch, performs a solvent-like or plasticizer-like action, participate primarily in the meltability and fluidity of the pitch or are difficult by themselves to manifest the laminate structure and to exhibit the optical anisotropy, but when benzene insoluble components B and C, that are residual components, can not be melted by themselves and can easily form the laminate, are contained within the specified ranges in a well-balanced proportion with respect to components O and A and if the chemical structure, characteristics and molecular weight of each component are within the specified range, optically anisotropic pitch necessary for producing a high-performance carbon fiber having a low softening point can be obtained.

In other words, it has been found that an optically anisotropic pitch containing about 2 wt% to about 20 wt% of component O, about 15 wt% to about 45 wt% of component A, about 5 wt% to about 40 wt% of component B (a benzene insoluble, quinoline soluble component) and about 20 wt% to about 70 wt% of component C (a benzene and quinoline insoluble component) and having a content of its optically anisotropic phase of at least about 90% by volume and a softening point of up to about 320° C. can provide further stabilized high-performance carbon fiber.

As for the abovementioned components B and C, as the constituents of an optically anisotropic pitch that can be melt-spun stably at a low temperature, they have the C/H atomic rato, fa, number-average molecular weight, and maximum molecular weight (molecular weight at a point integrated by 99% from the low molecular weight side) within the specified ranges, respectively, as will be described below.

The component B (a benzene insoluble, quinoline soluble component) has the C/H atomic ratio of at least about 1.5, fa of at least about 0.80, the number-average molecular weight of up to about 2,000 and the maximum molecular weight of up to about 10,000. Preferably, the C/H atomic ratio is about 1.5 to about 1.9, fa is about 0.80 to about 0.95 and the number-average molecular weight is about 800 to about 2,000. The component C (a benzene and quinoline insoluble component) has the C/H atomic ratio of up to about 2.3, fa of at least about 0.85, the estimated number-average molecular weight of up to about 3,000 and the maximum molecular weight of up to 30,000. Preferably, the C/H atomic ratio is about 1.8 to about 2.3, fa is about 0.85 to about 0.95 and the number-average molecular weight of about 1,500 to about 3,000.

The contents of these components are as follows: content B is about 5 wt% to about 55 wt%, preferably about 5 wt% to about 40 wt% and content C is about 20 wt% to about 70 wt% preferably about 25 wt% to about 65 wt%.

The inventors of the present invention have carried out intensive studies on optically anisotropic carbonaceous pitches having a specific composition and characteristics of the abovementioned components O, A, B and C and have found that among these optically anisotropic carbonaceous pitches, those having extremely excellent characteristics contain the optically anisotropic phase within the range of 80% to 100%, have a softening point in the range of 230° C. to 320° C., the number-average molecular weight in the range of about 900 to about 1,200, contain molecules having the molecular weight of up to 600 in the range of 30 mol% to 60 mol%, molecules having the molecular weight of at least 1,500 in the range of 15 mol% to 35 mol% and molecules having the molecular weight of 600 to 1,500 in the range of 20 mol% to 50 mol% and have the maximum molecular weight of up to 30,000.

The optically anisotropic carbonaceous pitch in accordance with the present invention has a large content of the optically anisotropic phase, is homogeneous and has a sufficiently low softening point as well as good fludity and moldability of pitch.

Various methods have been proposed in the past to produce an optically anisotropic carbonaceous pitch required for the production of a high-performance carbon fiber. All of these methods have however failed to provide optically anisotropic carbonaceous pitch suitable for the production of a carbon material having high strength and high elastic modulus, containing components O and A having the abovementioned specific composition, structure and molecular weight and further components B and C and having a specific molecular weight distribution. Moreover, these conventional methods involve various drawbacks such as listed below.

(1) The starting materials are not easily available industrially.

(2) The production calls for the reaction for an extended period of time or for the complicated process. Hence, the process costs high.

(3) When the content of the optically anisotropic phase is brought close to 100%, the softening point increases and spinning becomes difficult. If the softening point is kept low, on the other hand, the pitch becomes heterogeneous and spinning becomes difficult.

More particularly, the method disclosed in Japanese Patent Publication No. 8634/1974 either uses chrysene, anthracene, tetrabenzophenazine or the like that can not be obtained economically in large quantities, or requires complicated production processes such as distilling the tar of crude oil cracked at high temperature and thereafter filtrating unmolten matters at high temperature. Moreover, the spinning temperature of as high as 420° C. to 440° C. is required in this prior art. The method disclosed in Japanese Patent Laid-Open No. 118028/1975 relates to a method of obtaining heavy oils from the tar of crude oil cracked at high temperature as the starting material, by heating with agitation, but the reaction for an extended period of time and filtration of unmolten matters in the pitch at high temperature are necessary in order to obtain a pitch having a low softening point. Japanese Patent Publication No. 7533/1978 discloses a method which polycondenses petroleum tar and pitch by use of a Lewis acid type catalyst such as aluminum chloride. Since removal of the catalyst and heat-treatments before and after the removal of the catalyst are necessary, the method is complicated and its operation cost is high. In heat-polymerizing an optically anisotropic pitch as the starting material, the method of Japanese Patent Laid-Open No. 89635/1975 carries out the reaction under the reduced pressure or while bubbling an inert gas into the liquid phase until the optically anisotropic phase content reaches 40% to 90%. The resulting pitch contains quinoline insolubles and pyridine insolubles in an amount equal to that of the optically anisotropic phase. Japanese Patent Laid-Open No. 55625/1974 discloses an optically anisotropic carbonaceous pitch whose content of the optically anisotropic phase is just 100%, but the softening point as well as the spinning temperature are considerably high. As the starting material, the prior art reference discloses nothing but the use of certain commercially available petroleum pitches. If the pitch is produced in accordance with this process using many kinds of starting materials such as coal tar, distillation residue of petroleum and the like, the molecular weight becomes so great that spinning becomes infeasible due to the formation of unmolten matters or the rise of the softening point and spinning temperature. Thus, none of the prior art stipulate the composition or structure of the starting materials and they have practically failed to stably provide a carbonaceous pitch having a predetermined high quality.

To solve these problems of the prior art, the inventors of the present invention provided a novel technique, disclosed in the specification of the prior Japanese Patent Application No. 11124/1981. Namely, if an oily matter having a specific molecular weight and aromatic carbon fraction, fa, is selected from an oily matter containing a principal component with a boiling point in the range of 250° C. to 540° C., a homogeneous, optically anisotropic pitch having a low softening point can be obtained by subjecting the oily matter to thermal decomposition polycondensation and other necessary treatment. The present invention is completed by further developing this technique and uses, as the starting material, a heavier matter or a so-called "tar-like" material which contains at least a component having a boiling point of 540° C. or above as a principal component and preferably also contains a component having boiling points in the range of 360° C. to 540° C. The inventors have found that if a tar-like matter containing nonsaturated components (which will be described later in further detail) having specified molecular weight and fa are employed, a homogeneous, optically anisotropic pitch having a low softening point can be obtained stably with a high yield. Thus, the present invention is completed.

The boiling point range of the principal components of 360° C. or above and 540° C. or above as mentioned before almost corresponds to that of the distillation residue of heavy oils obtained by the distillation operation that can be generally carried out easily on a large scale by use of a distillation apparatus used generally in the petroleum or coal industry. Moreover, it corresponds to the boiling point range of effective components that can be thermally converted into pitch with a high yield.

Among the conventional technique, those disclosed in Japanese Patent Laid-Open Nos. 160427/1979, 58287/1980, 144087/1980, 2388/1981 and 57881/1981 are methods to concentrate those components which can easily form an optically anisotropic phase by effecting solvent extraction of an optically isotropic pitch or pitch containing a small amount of an optically anisotropic pitch. However, it is not clear what starting materials is to be used for these methods. There are a large variety of optically isotropic pitches or pitches containing an optically anisotropic phase in existence. In the case of these pitches, too, the characteristics of the pitches depend upon the molecular weight distribution and contents of aromatic groups of the starting heavy oils and desired pitches can not be obtained with reproducibility, though the pitches can be obtained at times.

As disclosed in Japanese Patent Laid-Open No. 57881/1981, optically anisotropic pitches produced in accordance with these methods have generally a high softening point of 320° C. or more in most cases, though the molecular weight distribution is relatively narrow. Accordingly, the optimal temperature for spinning the pitches is mostly close to 380° C. or above in which the thermal decomposition polycondensation reaction of the pitches can occur. In mass-producing pitch fibers on an industrial scale, therefore, problems are likely to occur in the operation and quality management. For, though solvent extraction of the optically antisotropic pitch to adjust its molecular weight distribution and distribution of the aromatic structure makes it possible to prepare an optically anisotropic pitch having a reduced content of high molecular weight components, low molecular weight components are likely to be removed excessively by the solvent so that components contributing to the fluidity of the resulting optically anisotropic phase decrease, eventually increasing the softening point and spinning temperature of the resulting optically anisotropic pitch.

In producing optically anisotropic pitch only by thermal decomposition polycondensation without resort to solvent extraction in accordance with the conventional method such as one disclosed in Japanese Patent Publication No. 1810/1979, the molecular weight and structural characteristics of the starting materials are not known. It is assumed that since the thermal decomposition polycondensation is carried out while removal of volatile matters is being strongly promoted by bubbling a large quantity of an inert gas, the content of low molecular weight aromatic hydrocarbons decreases in the resulting optically anisotropic phase, the optically anisotropic phase becomes essentially quinoline or pyridine insoluble and its softening point and spinning temperature become relatively high.

In contrast, when the present invention is employed, especially when the starting material of the present invention having the molecular weight distribution and characteristics of an aromatic structure within the specified ranges are employed, all the abovementioned problems with the prior art can be eliminated and hence, a peculiar optically anisotropic pitch capable of providing carbon materials for carbon fibers and graphite fibers of a higher quality can be obtained stably with a high yield and at low cost.

DISCLOSURE OF THE INVENTION

Accordingly, it is a principal object of the present invention to provide an optically anisotropic carbonaceous pitch suitable for the production of carbon fibers having high strength and high elastic modulus and also a process for producing the pitch.

It is another object of the present invention to provide an optically anisotropic carbonaceous pitch which has a low softening point, is homogeneous and excellent in the molecular orientation and can be melt-spun satisfactorily at a low temperature, and also a process for producing the pitch.

It is still another object of the present invention to provide an optically anisotropic carbonaceous pitch having improved spinnability by stipulating the molecular weight distribution among optically anisotropic carbonaceous pitches having a specific composition.

It is a further object of the present invention to provide a process for producing a novel optically anisotropic carbonaceous pitch having a specific molecular weight distribution among optically anisotropic carbonaceous pitches having a specific composition, by use of a tar-like matter containing, as its principal components, heavy hydrocarbons having a specific molecular weight distribution and specific constants related to the chemical structure.

Hereinafter, the present invention will be described in further detail.

One of the problems with the prior art is that though selection of the starting material is of the utmost importance in order to produce an excellent pitch, its technique has not sufficiently been developed, and selection of raw materials that ensure good balance between the development of the planar structure of condensed polycyclic aromatic groups and the growth of molecule size in the thermal decomposition polycondensation reaction has not been made. In other words, selection of the raw materials has not been made in such a fashion that a substantially homogeneous optically anisotropic pitch is formed as the planar structure of the molecules sufficiently develops before the molecules become excessively large or, while the softening point still remains at a low level, when viewed as a physical phenomenon.

Another problem with the prior art is that the method employed excessively removes low molecular weight components in the optically anisotropic phase, because the method uses solvent extraction or thermal decomposition polycondensation reaction involving vigorous evaporation.

Accordingly, the inventors of the present invention have examined the characteristics of the starting materials to obtain an optically anisotropic carbonaceous pitch suitable for the production of high-strength, high-modulus carbon materials, which pitch is substantially homogeneous and optically anisotropic, has a sufficiently low softening point and contains the aforementioned components O and A and further B and C having the specific composition, structure and molecular weight, and also the relationship between the starting materials and the characteristics of the resulting pitch. In the studies, among tar-like starting materials which are obtained from petroleum and coal and contain principal components having a boiling point of about 360° C. or above and also contain those having a boiling point of 540° C. or above, tar-like materials containing substantially no chloroform insolubles were studied. If the tar-like materials contained chloroform insolubles, the chloroform soluble components were collected, by simple filtration or centrifugal separation. Next, the tar-like starting materials were separated into an n-heptane insoluble component as an asphaltene content and an n-heptane soluble component using n-heptane. The n-heptane soluble component was then divided into a saturated component, an aromatic oil fraction and a resin fraction by column chromatography. Iijima's method was employed for the fractionation (Hiroshi Iijima, "Sekiyu Gakkaishi", 5, (8), 559, (1962)). This fractionation method comprises dissolving the sample in n-heptane to fractionate n-heptane insolubles as the asphaltene fraction, charging an n-heptane soluble component into a chromatography column packed with active alumina and causing it to flow down therein, eluting a saturated component with n-heptane, then an aromatic oil fraction with benzene and finally separating a resin component by elution with methanol and benzene.

The inventors have examined in detail the characteristics of each of the abovementioned saturated component, aromatic oil fraction, resin fraction and asphaltene fraction that together form the starting oil, and the relation of the properties, homogeneity and molecular orientation of the resulting pitch prepared from the starting oil and the characteristics of each component. As a result, the inventors have found that as the starting material for producing an optically anisotropic pitch which has high molecular orientation, is homogeneous, has a low softening point and can be stably spun at a low temperature for the production of a high-performance carbon fiber, the following requirements must be satisfied. Namely, among the components forming the starting oil, the following three components, i.e., the aromatic oil fraction, the resin fraction and the asphaltene fraction (hereinafter referred to as the "non-saturated components", i.e., components of the starting material other than the saturated components such as paraffinic hydrocarbons) must have sufficiently large fa (the ratio of carbon atoms of the aromatic structure to the total carbon atoms when measured by infrared absorption), sufficiently small number-average molecular weight (measured by vapor pressure equilibration) and sufficiently small maximum molecular weight (molecular weight at a point integrated by 99 wt% from the low molecular weight side) measured by gel permeation chromatography. As a result of intensive studies, it has been found that among the abovementioned three components, the presence of the aromatic oil fraction and resin fraction is important, though the proportion of each component is not so important. It has also been found that though the presence of the asphaltene fraction among the three components is not essential, a homogeneous, optically anisotropic carbonaceous pitch suitable for producing carbon materials having higher strength and higher elastic modulus can be produced with a higher yield if the asphaltene fraction having suitable characteristics is present.

It has been estimated further than the thermal decomposition polycondensation reaction of the starting oil to obtain the optically anisotropic carbonaceous pitch consists of the thermal decomposition and polycondensation of the starting heavy oil as the main reaction in which molecules of the pitch components are caused to change the chemical structure. The reaction is predominately directed to the development of the planar structure of condensed polycyclic aromatic groups due to the cleavage of the paraffinic chain structure, dehydrogenation, ring closure and polycondensation, and the optically anisotropic pitch is formed as the molecules having a well developed planar structure are associated with one another and aggregate and grow until one phase is formed. However, the saturated components in the starting oil have less characterizing features with respect to their molecular structure and are mostly excluded outside the system as the thermal decomposition occurs more predominantly than the thermal polycondensation during the thermal decomposition polycondensation reaction. It has thus been found that in stipulating the starting material in the present invention, the saturated components are not of much importance. In other words, the starting oil need not contain them at all or may contain them up to about 50%. If their content is too great, however, the pitch yield would be lowered or since the formation of the optically anisotropic phase becomes slow, the reaction needs an extended period of time.

Various oily matters or tar-like materials obtained from petroleum and coal contain sulfur, nitrogen and oxygen in addition to carbon and hydrogen. If the starting material contains large quantities of these elements, cross-linking or increase in the viscosity occurs during the thermal reaction so that the lamination of the plane of condensed polycyclic aromatic groups is impeded and a homogeneous, optically anisotropic pitch having a low softening point can not be obtained easily. Accordingly, it is preferred that the starting material for an intended optically anisotropic pitch contains up to 10 wt%, in total, of sulfur, nitrogen and oxygen in the tar-like matter consisting of carbon and hydrogen as the principal elements. Especially it is preferable that sulfur is no higher than 2 wt%. If the starting oil contains inorganic matters like catalyst particles or carbon that is insoluble in chloroform, these substances will remain in the resulting pitch during the thermal reaction, naturally impede spinnability when the pitch is to be spun and result in defects of the spun pitch fiber as it contains solid foreign matters. It is therefore necessary that the starting material should not contain substantial chloroform insolubles. When a tar-like substance containing 0.1 wt% or more of chloroform insolubles is filtered or centrifugally settled at a temperature higher by 50° to 100° C. than its softening point, there can be obtained a material which does not contain substantial chloroform insolubles. Characterizingly, this filtration or centrifugal settling can be generally carried out easily at a temperature of 100° to 200° C. without using a particular solvent.

As a result of studies, the inventors of the present invention have confirmed that a substantially homogeneous, optically anisotropic pitch which has about 80% to about 100%, preferably from about 90% to about 100%, of the optically anisotropic phase, and an extremely low softening point of about 230° C. to about 320° C., that can not be attained by the prior art, and hence which can be spun at a sufficiently low melt-spinning temperature of about 290° C. to about 370° C. can be obtained, if a tar-like material obtained from petroleum or coal as the starting material satisfies the following requirements. Namely, the tar-like material contains a principal component having a boiling point of 360° C. or above together with a component having a boiling point of 540° C. or above, which substantially contains neither chloroform insolubles nor n-heptane insolubles, but contains the two abovementioned non-saturated components, i.e., the aromatic oil fraction and the resin fraction, each having fa of at least 0.7 and preferably at least 0.75, number-average molecular weight of up to 1,000 and preferably up to 900 and maximum molecular weight of up to 2,000 and preferably up to 1,500. Alternatively, the starting material contains the three abovementioned non-saturated components, i.e., the aromatic oil fraction, the resin fraction and the asphaltene fraction, whereby each of the former two has fa of at least 0.7 and preferably at least 0.75, number-average molecular weight of up to 1,000 and preferably up to 900 and maximum molecular weight of up to 2,000 and preferably up to 1,500, while the asphaltene fraction has fa of at least 0.7, and preferably at least 0.75, number-average molecular weight of up to 1,500 and preferably up to 1,000 and maximum molecular weight of up to 4,000 and preferably up to 3,000.

If the starting material consisting of the non-saturated components, i.e., the aromatic fraction, the resin fraction and the asphaltene fraction, has a small asphaltene content of up to about 1 wt%, for example, the presence of the asphaltene fraction itself is effective unless a particularly heterogeneous asphalten fraction is added, and the asphaltene fraction in that case need not necessarily satisfy the abovementioned conditions of fa, number-average molecular weight and maximum molecular weight.

The lower limit of the number-average molecular weight of the abovementioned non-saturated components is generally about 250. Though the starting material containing the aromatic oil fraction having the number-average molecular weight smaller than the lower limit can be employed, the quantity of distillates would increase during the thermal reaction and the pitch yield would decrease. In order to obtain a homogeneous, optically anisotropic pitch having a low softening point, it is preferred that the number-average molecular weight of each of the three non-saturated components is close to that of the other in addition to the requirement that the number-average molecular weight of each of the three components be within the stipulated range. According to an empirical law, it is preferred that the value of the number-average molecular weight of the resin fraction does not exceed the twice of the number-average molecular weight of the aromatic oil fraction and when the asphaltene fraction exists in a significant amount, the number-average molecular weight of the asphaltene fraction does not exceed the twice that of the resin fraction. In other words, even if the width of the molecular weight distribution is sufficiently small in each component, the increase of the molecular weight due to polycondensation of part of the components proceeds enormously in an unbalanced manner if there is a large difference in the number-average molecular weights among the components. In such a case, a heterogeneous pitch portion would be generated and even if optically anisotropic homogeneous portions are collected and concentrated, the number average molecular weight and maximum molecular weight of these portions become so high that the softening point of the pitch also becomes high.

As will be described later, various methods can be applied as the thermal decomposition polycondensation method of the starting material consisting of the abovementioned two or three components as its principal components to produce an optically anisotropic carbonaceous pitch.

The optically anisotropic pitch produced in accordance with the process of the present invention can be spun at a temperature which is sufficiently and remarkably lower than the temperature for the thermal decomposition polycondensation reaction. Accordingly, the pitch is not much converted into heavy pitch during spinning and is always homogeneous so that high speed spinning becomes possible. It has been found that when a carbon fiber is prepared from this optically anisotropic pitch in a customary manner, there can be obtained a carbon fiber having extremely high performance.

The characterizing features of the optically antisotropic pitch obtained by the present invention are that it satisfies all of the three conditions, i.e., (1) high molecular orientation (optical anisotropy), (2) homogeneity and (3) low softening point (low melt-spinning temperature) that are essential conditions for pitches for producing high-performance carbon fibers.

Though the term "optically anisotropic phase" has not always been established in the art and has not been used in definite meanings from literature to literature, the term used herein has the following meaning. When the cross section of a pitch mass of the pitch, which is solidified at a temperature close to the room temperature, is polished and observed under a crossed nicol with a reflecting polarizing microscope, the portion at which luminance is observed when the sample or the crossed nicol is rotated is defined as the "optically anisotropic phase", and the portion at which luminance can not be observed, i.e. the optically isotropic portion, is defined as the "optically isotropic phase". The term "mesophase" is often used to indicate anisotropic phase of pitch.

There are two kinds of "mesophase"; one containing those components which are insoluble in quinoline or pyridine and the other containing those components which are soluble in quinoline or pyridine. The term "optically anisotropic phase" used in this specification principally refers to the latter "mesophase".

It is assumed that the optically anisotropic phase principally consists of molecules having a chemical structure in which the planarity of the condensed ring of polycyclic aromatic groups has developed to a degree greater than the optically isotropic phase. The molecules aggregate and associate with one another in a laminated form and remain in a kind of liquid crystal state at a melting temperature. When this is extrusion-spun through a thin spinneret, the planar surface of the molecules are oriented parallel to the direction of the fiber axis and hence, a carbon fiber prepared from this optically anisotropic pitch shows high strength and high elastic modulus. Determination of the optically anisotropic phase is made by measuring the proportion of the area occupied by the optically anisotropic phase portion by observing and photographing under the crossed nicol of a polarizing microscope. Hence, it substantially represents the percentage by volume.

As to the homogeneity of the pitch, the present invention defines those pitch as substantially homogeneous, optically anisotropic pitches which were found to have about 80% to about 100% of the optically anisotropic phase by means of the abovementioned measurement, in which foreign-particles (of a particle diameter of 1μ or more) are not detected substantially under microscopic observation of the pitch section and which are substantially devoid of foaming due to volatile matters at the melt-spinning temperature. Such pitches exhibit substantially perfect homogeneity in the practical melt-spinning operation. Among the pitches having the optically anisotropic phase of 70% to 80%, there are some pitches that have practically sufficient homogeneity during melt-spinning. In the case of substantially heterogeneous, optically anisotropic pitches having at least about 30% of the optically isotropic phase, they obviously consist of a mixture of the optically anisotropic phase having a high viscosity and the optically isotropic phase having a low viscosity. Spinning of such pitches means spinning of the mixture of the two pitch phases having remarkably different viscosities from each other, so that breakage occurs frequently. Therefore, high speed spinning is difficult to practice, yarns having a sufficiently small size can not be obtained and variances occur in the thickness of the fibers. The obvious heterogeneity of phases brings some defects in carbon fibers. As a result, high-performance carbon fibers can not be obtained from such pitches. If the pitches contain unmeltable fine solid particles or volatile matters of low molecular weight when they are melt-spun, spinnability is of course impeded and such defects as gas bubbles or solid foreign matters would be included in the spun pitch fibers.

The term "softening point" of the pitch used in this specification means a temperature at which the pitch changes from the solid to the liquid and is measured at the peak temperature of absorption and discharge of the latent heat of melting and solidification of the pitch by use of a differential scanning calorimeter. This temperature is in agreement with the softening point measured by other measuring methods such as a ring-and-ball method, a micro melting point method and the like within the range of ±10° C.

The term "low melting point" used herein means a softening point within the range of from about 230° C. to about 320° C. The softening point is closely related with the melt-spinning temperature of the pitch (the highest temperature at which the pitch is molten and fluidized inside the melt-spinning machine). Generally speaking, when the pitch is spun by the ordinary spinning method, the temperature at which the pitch shows a viscosity suitable for spinning is by about 60° C. to about 100° C. higher than the softening temperature. (The former does not necessarily indicate the temperature at the spinneret.) Accordingly, if the softening point is higher than about 320° C., melt-spinning is effected at a temperature higher than about 380° C. at which the thermal decomposition polycondensation occurs so that not only spinnability is deteriorated due to generation of decomposition gases and formation of unmolten matter, but the resulting spun pitch fiber contains gas bubbles and solid foreign matters and causes various defects. On the other hand, if the softening point is below 230° C., the thermosetting treatment must be carried out at a temperature as low as 200° C. or below for too long period of time. Hence, the treatment becomes complicated and costly to practice.

Next, the terms "fa", "number-average molecular weight" and "maximum molecular weight" used in this specification will be explained in further detail.

The term "fa" used herein means the ratio of carbon atoms of the aromatic structure to all the carbon atoms as measured by the C/H ratio analysis and infrared absorption method. Since the planar structure of the molecules is determined by the proportion of the condensed polycyclic aromatic groups, the number of naphthene rings, the number and length of side chains, and the like, the planar structure of the molecules can be considered using fa as an index. In other words, the greater the the condensed polycyclic aromatic group, the smaller the number of naphthene rings, the smaller the number of paraffinic side chains and the shorter the side chains, the greater becomes fa. Hence, the greater fa, the greater the planar structure of the molecules. Calculation and measurement of fa is carried out in accordance with the Kato's method (Kato et al., "Nenryokyokai-Shi", 55, 244 (1976)). The number-average molecular weight in this specification represents a value which is measured by the vapor pressure equilibration method using chloroform as the solvent. Molecular weight distribution is measured by fractionating a sample of the same system into 10 fractions by gel permeation chromatography using chloroform as the solvent, measuring the number-average molecular weight of each collected fraction by the vapor pressure equilibration method and preparing a working calibration curve using the number average molecular weight as the molecular weight of a reference material to measure the molecular weight distribution. The maximum molecular weight represents the molecular weight at a point integrated up to 99 wt% from the low molecular weight side of the molecular weight distribution measured by gel permeation chromatography.

Since the pitch components contain chloroform insolubles, the abovementioned measurement of molecular weight can not be made for the pitch as such. The molecular weight measurement of the pitch sample is therefore effected in the following manner. First, solvent fractionation analysis is made for each of the aforementioned components O, A, B and C. The components O and A are as such dissolved in the chloroform solvent. The components B and C are subjected in advance to a gentle hydrogenation reaction using metallic lithium and ethylenediamine and are then converted into chloroform-soluble substances without substantially changing their molecular weight. (This method is based on the description of "Fuel", 41, 67–69 (1962)). After the components are dissolved in the chloroform solvent, the number-average molecular weight is measured by the aforementioned vapor pressure equilibration method, the working calibration curves of gel permeation chromatograph of the pitch of this system are prepared and measurement of the molecular weight distribution chart is finally made.

The overall molecular weight distribution and calculation of number-average molecular weight of the pitch as a whole can be easily made from the content of each of components O, A, B and C and the data of their molecular weight distribution.

Each of the characteristic values of fa, number average molecular weight and maximum molecular weight of the non-saturated three components, i.e., the aromatic oil fraction, the resin fraction and the asphaltene fraction, becomes generally greater in the order of the aromatic oil fraction < the resin fraction < the asphaltene fraction. That is to say, in the ordinary starting oils, the aromatic oil fraction is a component that has the smallest planar structure and size of molecules (number-average molecular weight and maximum molecular weight) among the three non-saturated components, the resin fraction is a component whose planar structure and size of molecules fall between those of the aromatic oil fraction and those of the alphaltene fraction and the asphaltene fraction is a component that has the largest planar structure and size of molecules among the three components. However, this order is sometimes reversed.

Next, the relationship between the orientation, homogeneity (or compatibility) and softening point of the pitch for producing high-performance carbon fiber and the molecular structure of the pitch will be described.

The orientation of pitch is related with the planar structure of the molecules and with the liquid fluidity at a given temperature. Namely, it is the essential condition of a highly oriented pitch that the planar structure of the pitch molecules is sufficiently large and the pitch has sufficiently high liquid fluidity so that when the pitch is melt-spun, the plane surface of the molecules can rearrange in the direction of the fiber axis.

This planar structure of the molecules becomes greater if the condensed polycyclic aromatic groups are greater, the naphthene ring is smaller, the number of paraffinic side chains is smaller and the side chains are shorter. Hence, the planar structure can be examined using fa and molecular weight as indices. It is assumed that the greater fa and molecular weight, the greater the planar structure of the pitch molecules.

Liquid fluidity at a given temperature is determined by the degree of freedom of relative motion between molecules and between atoms and hence it can be considered using the bigness of the molecules, that is, the number-average molecular weight and molecular weight distribution (the influence of the maximum molecular weight is believed to be especially significant) as the index. Thus, if fa remains the same, liquid fluidity can be assumed to be greater if the molecular weight and maximum molecular weight are smaller. It is therefore important for a highly oriented pitch that fa is sufficiently great, the number-average molecular weight and maximum molecular weight are sufficiently small and relatively low molecular weight portion is sufficiently distributed in the molecular weight distribution.

Homogeneity of pitch (or compatibility of pitch components) is related with the similarity of chemical structures of the pitch molecules and with liquid fluidity at a given temperature. Accordingly, in the same way as in the case of orientation, the similarity of the chemical structures can be represented by the planar structure of the molecules and evaluated using fa as the index while the liquid fluidity can be evaluated using the number-average molecular weight and maximum molecular weight as the indicies. A homogeneous anisotropic pitch must therefore have a sufficiently small difference in fa and molecular weight among the pitch comprising molecules and sufficiently small maximum molecular weight. Furthermore, it is important that the composition and structure of the optically anisotropic phase be sufficiently similar to those of the optically isotropic phase.

Since the softening point means a temperature at which the pitch changes from the solid to the liquid, it is related with the degree of freedom of mutual motion of molecules determining the liquid fluidity at a given temperature. Hence, it can be evaluated using the bigness of molecules, i.e., the number-average molecular weight and molecular weight distribution of the molecules as the indicies. (Especially, the influence of the maximum molecular weight is believed to be significant.) It is therefore important for a pitch having a low softening point and hence a low melt-spinning temperature, that its number-average molecular weight and maximum molecular weight be sufficiently small and molecules having a relatively low molecular weight be distributed sufficiently in the molecular weight distribution.

Next, the relationship between the characteristics of the molecular structure of the starting material and the orientation, homogeneity and softening point of the pitch will be described. In producing an optically anisotropic pitch by the thermal decomposition polycondensation of the starting material, it is of the utmost importance that the balance between the growth of planar structure of the molecules of the condensed polycyclic aromatic groups and the growth of bigness of the molecules be kept during the reaction. During the process in which the heat reaction proceeds and the optically anisotropic phase is formed and grows into a homogeneous, optically anisotropic pitch, the growth of planar structure and liquid fluidity of the resulting pitch as a whole must be sufficiently maintained. In other words, it is necessary that the number-average molecular weight and maximum molecular weight should not become too great when the heat reaction has proceeded and the aromatic planar structure has sufficiently developed. Accordingly, it is assumed important that the planar structure of the molecules of the non-saturated components of the starting material, that is, fa, should be sufficiently large whereas the number-average molecular weight as well as the maximum molecular weight should be sufficiently small.

On the basis of these considerations, the inventors of the present invention have carried out intensive studies on the composition and structure of various tar-like materials containing a component having a boiling point of 360° C. or above and also a component having a boiling point of 540° C. or above, the heat reaction conditions and the characteristics of the resulting pitches. As a result, the inventors have found also that in such a case a homogeneous, optically anisotropic pitch having a low softening point can be obtained, if fa of each of the non-saturated components is sufficiently large while its number-average molecular weight and maximum molecular weight is sufficiently small and hence the planar structure of the molecules and the liquid fluidity well balance with each other. Namely, if fa of each of the two non-saturated components of the starting material, i.e., the aromatic oil fraction and the resin fraction, is at least 0.7 and preferably at least 0.75, its number-average molecular weight is up to 1,000 and preferably up to 900 and its maximum molecular weight is up to 2,000 and preferably up to 1,500 and, fa of the remaining non-saturated component, if any, i.e., the asphaltene component, is at least 0.7 and preferably at least 0.75, its number-average molecular weight is up to 1,500 and preferably up to 1,000, and still preferably up to 900 and its maximum molecular weight is up to 4,000 and preferably up to 3,000. The present invention is thus completed.

Explanation will be made in further detail. Even if the number-average molecular weight of each of the two non-saturated components, i.e., the aromatic oil fraction and the resin fraction, is up to 1,000 and its maximum molecular weight is up to 2,000, the planar structure of the molecule is out of balance with the liquid fluidity if fa of both, or either one, of the two components is below 0.7. In that event, the molecules grow into too big molecules before the planar structure of the molecules has sufficiently developed by the heat reaction and a substantially homogeneous, optically anisotropic pitch is formed, and the resulting pitch will have a too high molecular weight. If the reaction is further continued to form a substantially homogeneous, optically anisotropic pitch, the pitch has a high softening point (320° C. or above). Accordingly, a homogeneous, optically anisotropic pitch having a low softening point can not be obtained.

If the number-average molecular weight or maximum molecular weight of both, or either one of, the above-mentioned two non-saturated components of the starting material, i.e., the aromatic oil fraction and the resin fraction, are at least 1,000 and at least 2,000, respectively, even though fa of each component is at least 0.7, components having extremely high molecular weight are likely to be formed by the heat reaction and the resulting pitch becomes extremely heterogeneous or has reduced liquid fluidity. Accordingly, even if a substantially homogeneous, optically anisotropic pitch is formed, it has a high softening point (320° C. or above) and a homogeneous pitch having a low softening point can not be obtained.

In the case of a three-component starting oil containing likewise the aromatic oil fraction, the resin fraction and the asphaltene fraction as the non-saturated components, too, the planar structure of the molecules would be out of balance with the bigness of the molecules if fa of all or any one of the three non-saturated components is below 0.7, even if the number-average molecular weight of each of the aromatic oil fraction and the resin fraction is up to 1,000 and its maximum molecular weight is up to 2,000 while the number-average molecular weight of the asphalten fraction is up to 1,500 and its maximum molecular weight is up to 4,000, except when the asphalten content is extremely small. In such a case, the molecules would grow into macro-molecules before the planar structure of the molecules has sufficiently developed and a substantially homogeneous, optically anisotropic pitch is formed by the heat reaction. In consequence, the resulting pitch has a high molecular weight. Even if the reaction is further continued to form a substantially homogeneous, optically anisotropic pitch, the resulting pitch has a high softening point (320° C. or above) and hence a substantially homogeneous, optically anisotropic pitch having a low softening point can not be obtained.

Even though fa of all the three non-saturated components of the starting material is 0.7 or more, components having a higher molecular weight can be easily formed and the liquid fluidity of the resulting pitch would be reduced if the number average molecular weight of both, or either one, of the aromatic oil fraction and the resin fraction as the non-saturated components exceeds 1,000 or its maximum molecular weight exceeds 2,000, or if the number-average molecular weight of the asphaltene fraction exceeds 2,000 and its maximum molecular weight exceeds 4,000 and especially 5,000. In such a case, a homogeneous, optically anisotropic pitch having a low softening point can not be obtained because the pitch has a high softening point (320° C. or more) even if a substantially homogeneous, optically anisotropic pitch can be obtained.

As described in detail above, if the tar-like material having the specific characteristics of the present invention, that has not been disclosed conventionally, is used as the starting material, an optically anisotropic pitch for the production of carbon materials can be produced by various methods. This is also one of the essential features of the present invention. Namely, the production method may be one that effects the thermal decomposition polycondensation of the starting material while removing low molecular weight components at a temperature in the range of from 380° to 460° C. and preferably from 400° to 440° C. under a normal pressure in the flow of an inert gas (or under bubbling) and one that effects thermal reaction without evaporation and thereafter removes the low molecular weight components by heat treatment while carrying out vacuum distillation or evaporation using an inert gas. It is also possible to employ a method which carries out the thermal decomposition polycondensation under elevated pressure and then effects vacuum distillation or evaporation using an inert gas.

In other words, if the starting material of the present invention is used, the condition for the thermal decomposition polycondensation reaction (temperature, time, ratio of evaporation, etc.) can be selected easily over a wide range and an optically anisotropic pitch having a low softening point can be obtained with good reproducibility. However, among the abovementioned methods, particularly preferred is the one which carries out the thermal decomposition polycondensation while causing an inert gas to flow under normal pressure.

It is suitable for the object of the present invention to use a method which separates the optically anisotropic phase at the intermediate stage of the thermal decomposition polycondensation reaction, besides the method which produces the optically anisotropic pitch only by means of the thermal decomposition polycondensation reaction.

In accordance with the abovementioned method which solely depends upon the thermal decomposition polycondensation, a liquid crystal pitch is obtained by substantially one reaction process of thermal decomposition polycondensation reaction. Hence, the optically anisotropic phase formed at the initial stage of the reaction is kept exposed to a high temperature till the end of the reaction so that the molecular weight of the optically anisotropic phase is likely to become unnecessarily great. Accordingly, the softening point of the pitch is likely to become relatively higher even when the starting material system of the present invention is employed. In accordance with the method which separates the optically anisotropic pitch on the way of the thermal decomposition polycondensation reaction, it can prevent the molecules from growing into unnecessarily large macro-molecules. Hence, this is a preferred method in order to obtain a substantially homogeneous, optically anisotropic pitch having a low softening point.

In other words, it is more effective to employ such a method which comprises charging the tar-like material having the characteristics of the present invention as the starting material into a reaction vessel for the thermal decomposition polycondensation reaction, effecting the thermal decomposition polycondensation at a temperature in the range of 380° C. to 460° C., settling the polycondensed pitch at a temperature within the range of 350° to 400° C., in which the thermal decomposition polycondensation is not so fast to occur but the fluidity of the pitch is sufficiently maintained, for 30 minutes to the required number of hours until the polycondensed pitch (exclusive substantially of low molecular weight decomposition substances and unreacted matters) has come to contain 20 to 70% of the optically anisotropic phase, depositing an optically anisotropic phase portion having a large density in the lower layer as one continuous phase while permitting it to grow and age, and withdrawing the phase by separating it from an optically isotropic pitch having a lower density in the upper layer. In this case, too, preferred is a method which carries out the thermal decomposition polycondensation reaction under pressure of from 2 $Kg/cm^2$ to 200 $Kg/cm^2$, then evaporates the resulting decomposed matters and thereafter depositing the optically anisotropic phase in the lower layer.

A still preferred method comprises subjecting the tar-like material having the abovementioned characteristics of the present invention as the starting material to the thermal decomposition polycondensation reaction to form partially an optically anisotropic phase, depositing and separating said phase at a temperature at which the molecular weight of the optically anisotropic phase does not increase any longer, collecting a pitch in which the optically anisotropic phase is concentrated, and then heat-treating the pitch for a short time to finish it into an optically anisotropic pitch containing at least 90% of the optically anisotropic phase and having a desired softening point.

In other words, a suitable method involves the steps of subjecting the tar-like material having the characteristics of the present invention as the starting material to the thermal decomposition polycondensation reaction at a temperature of at least about 380° C. and preferably from 400° C. to 440° C. until the polycondensed pitch contains 20–70%, preferably 30–50% optically isotropic phase; settling the resulting polycondensed pitch for a relatively short period of from 5 minutes to the required number of hours while keeping the polymer at a temperature of about 400° C. or below and preferably from 360° C. to 380° C., or depositing in a high concentration the pitch portions of the optically anisotropic phase in the lower layer while fluidizing or stirring extremely gently, if necessary; separating the heavier layer having the high concentration of the optically anisotropic phase from the lighter layer of the optically anisotropic phase having the low concentration; and thereafter heat-treating the separated pitch of the heavier layer having the content of the optically anisotropic phase ranging from 70% to 90% at 380° C. or more and preferably 390° C. to 440° C. for a short period of time and thus changing it into a pitch having the content of the optically anisotropic phase of 90% or more or almost 100% and a desired softening point.

The step of subjecting the starting tar-like material to the thermal decomposition polycondensation in the abovementioned method generally involves evaporation for removing the low molecular weight substances formed by the decomposition outside the system of the liquid phase pitch. Especially when a pitch containing at least 80% of the optically anisotropic phase is produced only by the thermal decomposition polycondensation step, the yield of the resulting pitch would be lowered and its softening point would be increased, if the reaction is carried out under an excessively reduced pressure for an extended period of time or if stripping by an inert gas is applied at an excessively large flow rate for an extended period of time. For, if evaporation is too strong, the low molecular weight components of the optically anisotropic phase are reduced excessively.

On the other hand, if the degree of vacuum is too low or if the flow rate is too small in stripping by the inert gas, the decomposition products would remain in the reaction system too long and an extended period of time would be required for the growth and concentration of the optically anisotropic phase. In the interim, polycondensation also proceeds so that the molecular weight distribution becomes too wide, deteriorating eventually the homogeneity and softening point of the resulting pitch.

The degree of vacuum or the flow rate of the inert gas in the abovementioned thermal decomposition polycondensation step should be selected in accordance with the kind of the starting material, the shape of the reactor, the reaction temperature and time, and so forth, and so it is difficult to set them strictly. If the starting material of the present invention is used, the final vacuum of from 1 to 50 mmHg is suitable at a temperature of from 380° to 430° C. if the reaction is carried out under a reduced pressure and the suitable flow rate is from 0.5 to 5 l/min per 1 Kg of sample if the inert gas is caused to flow.

More particularly, when the reaction is carried out at a relatively low temperature in the range of 380° to 400° C. for more than 10 hours, the final vacuum is preferably 3 to 50 mmHg if the reaction is carried out under a reduced pressure and the flow rate is preferably from 0.5 to 3 l/min/kg sample if the inert gas is caused to flow. If the reaction is terminated within a few hours at a temperature in the range of 410° to 430° C., the final vacuum is preferably 1 to 20 mmHg in the reduced pressure method and the flow rate is preferably 2 to 5 l/min/kg in the inert gas stream method.

The inert gas may be blown into the pitch so as to cause bubbling or may be caused to flow merely on the liquid surface. It is preferred to pre-heat the flowing inert gas lest the liquid phase of the reaction system is cooled.

In order to ensure a homogeneous reaction of the liquid phase of the reaction system, sufficient fluidization or agitation is of course necessary. Fluidization or agitation of the reaction liquid phase can be effected by causing the heated inert gas to flow therethrough. The inert gas must have extremely low chemical reactivity but high vapor pressure. As the inert gas, it is possible to use ordinary inert gases such as argon, nitrogen, steam, carbon dioxide gas, methane, ethane and other low molecular weight hydrocarbons.

In the abovementioned method, the inert gas need not always be caused to flow if a pitch, in which the optically anisotropic pitch is concentrated to 70 to 90% and which has a sufficiently low softening point, is further heat-treated in order to attain the concentration of the optically anisotropic phase of at least 90% and to adjust the softening point to a desired point by raising it a little. Needless to say, however, this adjustment can be carried out by causing the inert gas to flow and effecting evaporation in the same way as in the abovementioned thermal decomposition polycondensation step.

If the specific starting tar-like material, in which the average molecular weight of each non-saturated component is sufficiently small, the width of the molecular weight distribution is narrow and the aromatic structure of the molecules has sufficiently developed, is used in accordance with the process of the present invention, the resulting optically anisotropic pitch behaves as a substantially homogeneous, optically anisotropic pitch in spinning or the like, though it does not necessarily have 100% optically anisotropic phase, and it has an extremely low softening point, though it contains at least 80% and generally at least 90% of the optically anisotropic phase. Accordingly, the resulting pitch has the characteristic that a sufficiently low melt-spinning temperature can be employed practically. The optically anisotropic pitch produced in accordance with the process of the present invention is found to be included in the range of the composition and characteristics of the pitch substances, components O, A, B and C disclosed in the prior Japanese Patent Application No. 162972/1980, and its particular molecular distribution is also observed.

From the analysis of a large number of optically anisotropic pitches produced in accordance with the process of the present invention, it has been found that their number-average molecular weight is within the range of from about 900 to about 1,500 and varies in accordance with the starting material and the production process but mostly falls within the range of from about 1,000 to about 1,100, and the pitches having such a number-average molecular weight has a greater content of the optically anisotropic phase, is homogeneous and has a sufficiently low softening point.

Further amazingly, even in the pitches in which the optically anisotropic phase accounts for at least 90% and further substantially 100%, low molecular substances of molecular weight of up to 600 in quantities as large as 30 mol% to 60 mol% are contained. This is one of the greatest characterizing features. It is assumed that this phenomenon occurs because the starting material and process of the present invention are employed, and eventually lowers the softening point of the optically anisotropic phase and improves the fluidity and moldability of the pitch.

It is the second feature that in conjunction with the distribution of higher molecular weight components, 15 mol% to 35 mol% of components having a molecular weight of 1,500 or more are contained. Nonetheless, the maximum molecular weight (number-average molecular weight of 1 wt% fraction on the high molecular weight side) does not exceed about 30,000. It is also assumed that this, too, results from the use of the starting material and process of the present invention. These high molecular weight components serve as the skeletal components in the pitch that contribute to the orientation of the optically anisotropic phase and to the molding strength, and make it possible to spin thin and strong pitch fibers.

The remaining components having an intermediate molecular weight or those having a molecular weight of from 600 to 1,500, exist in the range of 20 mol% to 50 mol% in the pitch of the present invention.

Since the starting material of the present invention as described above is used, the optically anisotropic carbonaceous pitch prepared by the various processes of the present invention has a low softening point, though it is a sufficiently homogeneous pitch containing 80 to 100% of the optically anisotropic phase, and provides the following various advantages that have not so far been accomplished by the prior art.

(1) An optically anisotropic carbonaceous pitch consisting of a substantially homogeneous, optically anisotropic phase and having a low softening point (e.g. 260° C.) can be produced within a short period of time (e.g. 3 hours for the overall reaction) without calling for complicated and costly procedures such as high temperature filtration of unmolten matters, solvent extraction, removal of a catalyst, and so forth. Accordingly, a low optimal spinning temperature (the highest temperature suited for melting, fluidizing and transferring the pitch, and excluding gas bubbles inside a melt-spinning machine) can be set in the range of from 290° C. to 370° C. and preferably from 300° C. to 360° C. in producing carbon fibers.

(2) The optically anisotropic carbonaceous pitch produced in accordance with the process of the present invention is excellent in homogeneity and makes it possible to continuously spin a fiber of a substantially uniform thickness having a flat surface at a temperature by far lower than about 400° C. and hence spinnability (in the aspects of frequency of yarn breakage, yarn thickness, yarn variance) is excellent. Since degradation does not occur during spinning, the quality of the carbon fiber as the product is stable.

(3) Decomposition gases and unmolten matters are not substantially formed during spinning so that high speed spinning is feasible, the spun pitch fiber has fewer defects and the strength of the carbon fiber becomes high.

(4) Since carbon fiber can be produced by spinning the optically anisotropic pitch which is substantially in the form of liquid crystal as a whole, the orientation of the graphite structure well develops in the direction of the fiber axis and a carbon fiber having high elastic modulus can be obtained.

As a matter of fact, when the optically anisotropic pitch produced in accordance with the process of the present invention is used for producing a carbon fiber in a customary manner, a carbon fiber having extremely high strength as well as elastic modulus can be obtained with high production stability. Namely, a sufficiently homogeneous, optically anisotropic pitch (containing 80% to 100% optically anisotropic phase) obtained by the process of the present invention can be easily melt-spun by the ordinary melt-spinning method at a temperature of 370° C. or below and the spun fiber has low frequency of yarn breakage and can be wound at a high speed. Fibers having a 5 to 10μ diameter can also be obtained.

The pitch fiber obtained from the optically anisotropic pitch produced by the present invention can be thermoset at a temperature of 200° C. or above for 10 minutes to 2 hours in an oxidizing atmosphere. Though varying to some extent depending upon the fiber diameter, a carbon fiber obtained by carbonizing the thermoset pitch fiber at 1,300° C. has tensile strength of $2.0\times10^9$–$3.7\times10^9$ Pa and tensile elastic modulus of $1.5\times10^{11}$–$3.0\times10^{11}$ Pa. When the pitch fiber is carbonized up to 1,500° C., a carbon fiber having tensile strength of $2.0\times10^9$–$4.0\times10^9$ Pa and tensile elastic modulus of $2.0\times10^{11}$–$4.0\times10^{11}$ Pa can be obtained.

EXAMPLE 1

As the starting material was used a tar-like substance in the bottom of a distillation column which was obtained by vacuum distilling a heavy residue by-produced in the catalytic cracking of petroleum and had a boiling point of at least about 400° C. under normal pressure.

This tar-like substance contained about 20 vol% of components having a boiling point of at least 540° C. under normal pressure and less than 0.05 wt% of chloroform insolubles, consisted of 89.5 wt% of carbon, 8.9 wt% of hydrogen and 1.5 wt% of sulfur and had the composition and properties as illustrated in Table 1-1(a).

Separation of the four components of the starting oil defined in this specification was made in accordance with the Iijima's method (Hiroshi Iijima, "Sekiyu Gakkai-Shi", 5, (8), 559 (1962)), in the following manner. 2 g of the sample was dissolved in 60 ml of n-heptane. The n-heptane insolubles were fractionated as the asphaltene fraction while the n-heptane soluble fraction was charged into chromatographic column tube (column temperature 50° C.), equipped with a hot water jacket of a 2 cm inner diameter and a 70 cm length and packed with 75 g of active alumina. After the n-heptane soluble fraction was caused to flow down through the column, the saturated components were eluted with 300 ml of n-heptane and the aromatic oil fraction was then eluted with 300 ml of benzene and was finally eluted sufficiently with methanol-benzene to separate the resin fraction.

1,000 g of this tar-like substance was charged in a stainless reactor having a 1.45 l capacity and was subjected to the thermal decomposition polycondensation reaction under normal pressure and 430° C. for 2 hours while the nitrogen gas was caused to flow at the rate of 5 l/min (over the liquid surface without being blown into the liquid phase of the sample).

Temperature was raised at the rate of 15° C./min and cooling was made from 430° C. down to 250° C. in the course of about 10 minutes. Agitation was made from the start of the temperature rise to cooling down to 250° C. so that the liquid phase of the reaction system was kept at a uniform temperature.

When the residual pitch after the reaction was examined, a pitch containing about 45% of optically anisotropic spherulite and having a softening point of 197° C. was obtained in the yield of 19.5 wt%.

Next, 100 g of this pitch was placed in a 200 ml cylindrical glass vessel of 5 cm diameter and was left standing at 380° C. for 2 hours in the nitrogen atmosphere. After the pitch was cooled down to room temperature, the glass vessel was broken and the pitch was collected.

It was observed even with naked eye from the difference of luster of the pitch that the pitch was separated into the upper layer and the lower layer, and the pitch mass of the upper layer could be separated by peeling from that of the lower layer. About 35 g of the lower layer pitch could be obtained. When this lower layer pitch was examined, the pitch was found to be a carbonaceous pitch having a softening point of 263° C. and consisting of at least 99% of the optically anisotropic phase that scarcely contained the optically isotropic phase. The resulting optically anisotropic pitch was charged in a spinning machine having a nozzle of 0.5 mm diameter. While melted and held at 340° C., the pitch was extruded under a nitrogen pressure of about 100 mmHg and was wound on a bobbin rotating at a high speed for spinning. A pitch fiber having an average fiber diameter of about 8 μm could be obtained at a take-up speed of 500 m/min for an extended period of time without yarn breakage. The pitch fiber thus obtained was oxidized for thermosetting in a customary manner and was then carbonized at 1,500° C. in an inert gas to obtain a carbon fiber.

The carbon fiber had a 6.6 μm diameter, average tensile strength of 3.5 GPa and tensile elastic modulus of 320 GPa.

When the molecular weight distribution of this optically anisotropic pitch was examined in accordance with the aforementioned method, the characteristics such as shown in Table 1-1(b) were found out.

TABLE 1-1

(Example 1)

| | Proportion wt % | fa | Number-average molecular weight | Maximum molecular weight |
|---|---|---|---|---|
| (a) Tar composition and properties | | | | |
| saturated component | 31.1 | — | 404 | — |
| aromatic oil fraction | 53.5 | 0.82 | 290 | 590 |
| resin fraction | 11.4 | 0.83 | 330 | 800 |
| asphaltene fraction | 4.0 | 0.82 | 650 | 2500 |

| (b) Molecular weight distribution of optically anisotropic pitch | |
|---|---|
| number-average molecular weight | 1,030 |
| maximum molecular weight | 18,000 |
| molecular weight up to 600 mol % | 57.2 |
| 600–1500 mol % | 23.5 |
| 1500 mol % or more | 19.2 |

EXAMPLE 2

The heavy oil from which the tar-like substance of Example 1 was prepared, was used as the starting material without distillation.

This heavy distillation residue contained about 10 vol% of a fraction having a boiling point of lower than 360° C. under normal pressure and about 10 vol% of a fraction having a boiling point of at least 540° C., but was principally composed of hydrocarbons having a boiling point of at least 360° C. It was a tar-like material consisting of 88.8 wt% of carbon, 9.6 wt% of hydrogen and 1.6 wt% of sulfur. Its chloroform insoluble content was less than 0.05% and its composition and properties are illustrated in Table 1-2(a).

This tar-like substance was subjected to the thermal decomposition polycondensation reaction at 430° C. for five hours in the same way as in Example 1 except that the nitrogen gas was caused to flow at the rate of 2 l/min. The pitch at the bottom of the still was withdrawn.

The pitch yield was about 12 wt%, its content of the optically anisotropic phase was about 95% and its softening point was 307° C. The molecular weight distribution of this pitch is shown in Table 1-2(b).

When spun in the same way as in Example 1, this pitch could be spun at a spinning temperature of 370° C. A carbon fiber obtained by thermosetting this pitch fiber and then carbonizing it by heating to 1,300° C. had an average diameter of 9.6μ, average strength of 2.4 GPa and average elastic modulus of 175 GPa.

TABLE 1-2

(Example 2)

| | Proportion wt % | fa | Number-average molecular weight | Maximum molecular weight |
|---|---|---|---|---|
| (a) Tar composition and properties | | | | |
| saturated components | 36.4 | — | 480 | — |
| aromatic oil fraction | 53.8 | 0.81 | 280 | 570 |
| resin fraction | 7.4 | 0.84 | 420 | 750 |
| asphaltene fraction | 2.5 | 0.80 | 600 | 2300 |
| (b) Molecular weight distribution of optically anisotropic pitch | | | | |
| number-average molecular weight | | | 1150 | |
| maximum molecular weight | | | 23,000 | |
| molecular weight up to 600 mol % | | | 35.8 | |
| 600–1500 mol % | | | 36.6 | |
| 1600 mol % or more | | | 27.6 | |

COMPARATIVE EXAMPLE 1

As the starting material was used a tar-like substance at the bottom of a still that was obtained by vacuum distilling a tar-like substance by-produced in the catalytic cracking of petroleum and had a boiling point of at least about 400° C. under normal pressure.

The tar-like substance had a chloroform insoluble content of less than 0.1 wt% and consisted of 92.2 wt% of carbon, 6.8 wt% of hydrogen and 0.8 wt% of sulfur. Its composition and properties are shown in Table 2-1(a).

When this tar-like substance was subjected to the thermal decomposition polycondensation in the same way and under the same condition as in Example 1, 397 g of residual pitch was obtained which had a softening point of 190° C. and the content of the optically anisotropic phase of about 35%. When 100 g of this pitch was subjected to the deposition separation treatment of the optically anisotropic phase in the same way and under the same condition as in Example 1, at least 25 g of pitch was obtained as the lower layer pitch. This pitch scarcely contained the optically isotropic phase, or was composed of at least 99% of the optically anisotropic phase. The softening point of this pitch was 338° C. The molecular weight distribution of this pitch is shown in Table 2-1(b).

When the same starting material was subjected to the treatment in exactly the same way and under exactly the same condition as in Example 2 in order to obtain the optically anisotropic pitch by means of the thermal decomposition polycondensation alone, the resulting pitch has the content of the optically anisotropic phase of about 95% but its softening point was 341° C.

The pitch was found to possess the molecular weight distribution such as shown in Table 2-1(c).

The pitch having a relatively high softening point could not be spun at the melt-holding temperature of up to 380° C. by the same method as in Example 1.

TABLE 2-1

(Comparative Example 1)

| | Proportion wt % | fa | Number-average molecular weight | Maximum molecular weight |
|---|---|---|---|---|
| (a) Tar composition and properties | | | | |
| saturated components | 8.8 | — | 590 | — |
| aromatic oil fraction | 62.9 | 0.82 | 360 | 920 |
| resin fraction | 7.8 | 0.84 | 420 | 1050 |
| asphaltene fraction | 20.5 | 0.77 | 1020 | 3300 |
| (b) Molecular weight distribution of optically anisotropic pitch | | | | |
| number-average molecular weight | | | 1,280 | |
| maximum molecular weight | | | 36,000 | |
| molecular weight up to 600 mol % | | | 33.1 | |
| 600–1500 mol % | | | 27.7 | |
| 1500 mol % or more | | | 39.2 | |
| (c) Molecular weight distribution of optically anisotropic pitch | | | | |
| number-average molecular weight | | | 1,300 | |
| maximum molecular weight | | | 39,000 | |
| molecular weight up to 600 mol % | | | 18.8 | |
| 600–1500 mol % | | | 38.7 | |
| 1500 mol % or more | | | 42.5 | |

COMPARATIVE EXAMPLE 2

As the starting material was used a tar-like substance at the bottom of a still which was obtained by vacuum distilling a tar-like substance by-produced in the steam cracking of naphtha and had a boiling point of about 400° C. calculated under normal pressure.

This tar-like substance did not contain more than 0.1 wt% of chloroform insolubles and was composed of 92.5 wt% of carbon, 7.5 wt% of hydrogen and 0.1 wt% of sulfur. Its composition and properties are shown in Table 2-2(a).

When this tar-like substance was subjected to the thermal decomposition polycondensation reaction at 390° C. for 3 hours in the same way as in Example 1, a pitch having a softening point of 263° C. was obtained as the residual pitch. However, this pitch was completely optically isotropic. When the pitch was likewise subjected to the thermal decomposition polycondensation at 415° C. for 3 hours, the residual pitch had a softening point of 335° C. and contained about 20% of the optically anisotropic phase consisting as a whole of fine spheres having a diameter of 50μ or below.

Deposition of the optically anisotropic phase could not be made from these pitches.

TABLE 2-2

(Comparative Example 2)
(a) Tar composition and properties

| | proportion wt % | fa | number-average molecular weight | maximum molecular weight |
|---|---|---|---|---|
| saturated components | 0.6 | — | — | |

TABLE 2-2-continued

| (Comparative Example 2) (a) Tar composition and properties | proportion wt % | fa | number-average molecular weight | maximum molecular weight |
|---|---|---|---|---|
| aromatic oil fraction | 20.2 | 0.78 | 340 | 620 |
| resin fraction | 6.6 | 0.80 | 680 | 1300 |
| asphaltene fraction | 72.2 | 0.80 | 870 | 16,000 |

COMPARATIVE EXAMPLE 3

As the starting material was used a still bottom oil obtained by distillation of a crude oil under normal pressure.

This tar-like substance consisted principally of hydrocarbons having a boiling point of about 360° C. or more and composed of 86.8 wt% of carbon, 13.0 wt% of hydrogen and 0.2 wt% of sulfur. Its composition and properties are shown in Table 2-3(a). It did not contain the chloroform insolubles.

When this starting tar was subjected to the thermal decomposition polycondensation reaction at 430° C. for 2 hours in the same way as in Example 1, residual pitch was obtained in a yield of about 18%. However, the pitch was separated into about 40% of upper layer and about 60% of lower layer inside the reactor. The upper layer was a pitch having a softening point of 176° C. and containing about 10% of fine spheres of the optically anisotropic phase, and the lower layer was a pitch having a softening point of 396° C. and containing about 70% of the optically anisotropic phase of complicated shapes.

When the same starting material was thermally reacted at 430° C. for 3 hours, the residual pitch was separated into about 25% of the upper layer and about 75% of the lower layer in a total yield of about 15% inside the reactor. The upper layer was a pitch containing 5 to 10% of the optically anisotropic phase and having a softening point of 232° C. and the lower layer was a pitch containing about 80% of the optically anisotropic phase and having a softening point of 400° C. or above.

TABLE 2-3

| (Comparative Example 3) (a) Tar composition and properties | proportion wt % | fa | number-average molecular weight | maximum molecular weight |
|---|---|---|---|---|
| saturated components | 34.6 | — | 550 | — |
| aromatic oil fraction | 29.3 | 0.28 | 420 | 1300 |
| resin fraction | 30.5 | 0.30 | 470 | 3,400 |
| asphaltene fraction | 1.7 | 0.25 | 2100 | 26,000 |

COMPARATIVE EXAMPLE 4

As the starting material was used a tar-like substance consisting principally of hydrocarbons by-produced in the refining process of petroleum having a boiling point of 540° C. or above.

This tar-like substance did not contain chloroform insolubles and consisted of 85.4 wt% of carbon, 11.4 wt% of hydrogen and 3.2 wt% of sulfur. Its composition and properties are shown in Table 2-4.

This starting tar was subjected to the thermal decomposition polycondensation reaction at 415° C. by the same method as in Example 1 which changing the reaction time to 2 hours, 3 hours and 4 hours. When the resulting residual pitches were examined, it was found that the yield, the softening point and the optically anisotropic phase were 25.2%, 79° C. and 0% when the reaction time was 2 hours, 18.9%, 165° C. and about 10% when the reaction time was 3 hours and 18.0%, 400° C. or above and about 40% when the reaction time was 4 hours, respectively.

The optically anisotropic phase of each of these pitches could not be deposited and concentrated by further treatment.

TABLE 2-4

| (Comparative Example 4) Tar composition and properties | proportion wt % | fa | number-average molecular weight | maximum molecular weight |
|---|---|---|---|---|
| saturated components | 19.7 | — | 710 | — |
| aromatic oil fraction | 67.5 | 0.26 | 640 | 1,600 |
| resin fraction | 12.2 | 0.34 | 1100 | 3,500 |
| asphaltene fraction | 0.0 | — | — | — |

EXAMPLE 3

The same tar-like substance as used in Example 1 was employed as the starting material. 700 g of this tar-like substance was chanrged in a stainless steel autoclave having a 1 l capacity, held at 430° C. and subjected to the thermal decomposition polycondensation for 5 hours with agitation. In the interim, the pressure inside the autoclave was raised to 173 kg/cm$^2$. After the reaction, the reaction product was left standing and gradually cooled down to 200° C. After the content was withdrawn, 400 g was charged into a stainless steel reactor having a 500 ml capacity. While the nitrogen gas was being blown at a rate of 5 l/min, the decomposition products were primarily evaporated at 380° C. for 3 hours, thereby providing 153 g of the residual pitch. Next, 100 g of this pitch was placed in a 200 ml glass cylinder, settled at 380° C. for 2 hours in the nitrogen atmosphere and left standing and gradually cooled down to room temperature. Thereafter, the pitch mass was collected by destroying the glass cylinder.

It was found from the difference in luster that this pitch mass was separated into the upper layer and the lower layer. They could be separated from each other by peeling and 17.4 g of the lower layer pitch was obtained. The resulting pitch had a softening point of 256° C. and mostly consisted of the optically anisotropic phase containing about 2% of the optically isotropic phase. Its molecular weight distribution is shown in Table 1-3.

TABLE 1-3

| (Example 3) Molecular weight distribution of optically anisotropic pitch | |
|---|---|
| number-average molecular weight | 1090 |
| maximum molecular weight | 13,000 |
| molecular weight up to 600 mol % | 42.7 |
| 600–1500 mol % | 35.4 |

TABLE 1-3-continued

| (Example 3) | |
|---|---|
| Molecular weight distribution of optically anisotropic pitch | |
| 1500 mol % or more | 21.9 |

TABLE 1-4-continued

| (Example 4) | |
|---|---|
| 600–1500 mol % | 21.6 |
| 1500 mol % or more | 22.7 |

EXAMPLE 4

As the starting material was used a tar-like substance of the bottom of a still obtained by vacuum distilling a heavy residue by-produced in the catalytic cracking of petroleum and having a boiling point of at least about 420° C.

This tar-like substance contained about 20 vol% of components having a boiling point of at least 540° C. under normal pressure and its chloroform insoluble content was up to 0.1 wt%. It consisted of 91.0 wt% of carbon, 7.7 wt% of hydrogen and 1.3 wt% of sulfur and its composition and properties are shown in Table 1-3(a).

24.9 kg of this tar-like substance was charged in a stainless steel reactor having a 40 l capacity and subjected to the thermal decomposition polycondensation reaction at 415° C. for 4 hours. During this time, the nitrogen gas was blown at a rate of 75 l/min and the liquid phase of the reaction was kept at a uniform temperature by an impeller type agitator.

After the reaction, the residual pitch was immediately transferred into a stainless steel separation tank having a 7 l capacity and held at about 375° C. for 2 hours without agitation. Next, a valve of a discharge line at the lower part of the separation tank was opened to discharge the pitch. 1.96 kg of pitch was collected before the pitch viscosity dropped rapidly and its outflow became quick.

Upon analysis, the pitch was found to contain about 93% of the optically anisotropic phase and to possess a softening point of 255° C. Its molecular weight distribution is shown in Table 1-3(b).

This pitch could be easily melt-spun by the same method and under the same condition as in Example 1 and a pitch fiber having an average diameter of 9 μm could be obtained. The fiber was oxidized and infusibilized and was heated for carbonization to 1,300° C., thereby providing a carbon fiber having an average diameter of 7.4 μm, average strength of 3.1 GPa and average elastic modulus of 210 GPa. When the infusibilized fiber was heated to 1,500° C. for carbonization, there could be obtained a carbon fiber having an average diameter of 7.2 μm, average strength of 3.4 GPa and average elastic modulus of 290 GPa.

TABLE 1-4

(Example 4)

| | proportion wt % | fa | number-average molecular weight | maximum molecular weight |
|---|---|---|---|---|
| (a) Tar composition and properties | | | | |
| saturated components | 15.5 | — | 450 | — |
| aromatic oil fraction | 53.1 | 0.78 | 300 | 650 |
| resin fraction | 25.8 | 0.81 | 440 | 900 |
| asphaltene fraction | 5.5 | 0.79 | 630 | 2100 |

| (b) Molecular weight distribution of optically anisotropic pitch | |
|---|---|
| number-average molecular weight | 1090 |
| maximum molecular weight | 16,000 |
| molecular weight up to 600 mol % | 55.7 |

EXAMPLE 5

The thermal decomposition polycondensation reaction was carried out using the same starting material and the same experimental instruments under the same condition as in Example 4. The resulting pitch was transferred to the separation tank in the same way as in Example 4 and left standing at about 400° C. for 30 minutes. 2.23 kg of the lower layer pitch portion having a relatively large viscosity was collected from the discharge line. The pitch contained 20 to 30% of the optically isotropic phase and had a softening point of 248° C. The pitch was difficult to spin by the same melt-spinning method as in Example 1 and yarn breakage occurred frequently.

Next, 400 g of this pitch was packed in a stainless steel vessel having a 500 ml capacity and held at 400° C. While the nitrogen gas was being blown at a rate of 2 l/min, heat-treatment was carried out additionally.

The resulting pitch contained at least 95% of the optically anisotropic phase and had a softening point of 274° C. The pitch having the optically anisotropic phase and softening point adjusted in this manner could be spun at a spinning temperature of 350° C. for an extended period of time. The molecular weight distribution of this optically anisotropic pitch is shown in Table 1-5.

TABLE 1-5

| (Example 5) | |
|---|---|
| Molecular weight distribution of optically anisotropic pitch | |
| number-average molecular weight | 1,130 |
| maximum molecular weight | 24,000 |
| molecular weight up to 600 mol % | 48.3 |
| 600–1500 mol % | 26.6 |
| 1600 mol % or more | 25.1 |

EXAMPLE 6

As the starting material was used a tar-like substance at the bottom of a still obtained by vacuum distilling a heavy residue by-produced in the refining of petroleum and having a boiling point of at least about 540° C. under normal pressure. This tar-like substance has a chloroform insoluble content of less than 0.1 wt% and consisted of 92.5 wt% of carbon, 6.6 wt% of hydrogen and 0.9 wt% of sulfur. Its composition and properties are shown in Table 1-6(a).

1,000 g of this tar-like substance was subjected to the thermal decomposition polycondensation reaction at 430° C. for 2.5 hours in the same way as in Example 1. The resulting residual pitch was obtained in an amount of 346 g, contained about 65% of the optically anisotropic spheres and had a softening point of 251° C.

Next, 100 g of this pitch was placed in a 200 ml cylindrical glass vessel and settled at 380° C. for 2 hours. After left standing down to room temperature the pitch was collected by destroying the glass vessel. The pitch was separated into the upper layer pitch and the lower layer pitch in the same way as in Example 1. About 68 g of the lower layer pitch was obtained. Its softening point was 272° C. and its content of the optically anisotropic phase was about 92%. The molecular weight distribution is shown in Table 1-6(b).

TABLE 1-6

(Example 6)

| | proportion wt % | fa | number-average molecular weight | maximum molecular weight |
|---|---|---|---|---|
| (a) Tar composition and properties | | | | |
| saturated components | 1.9 | — | — | — |
| aromatic oil fraction | 23.4 | 0.79 | 370 | 760 |
| resin fraction | 12.2 | 0.79 | 450 | 1,600 |
| asphaltene fraction | 62.5 | 0.83 | 710 | 2,800 |
| (b) Molecular weight distribution of optically anisotropic pitch | | | | |
| number-average molecular weight | | | 1,160 | |
| maximum molecular weight | | | 24,000 | |
| molecular weight up to 600 mol % | | | 37.4 | |
| 600–1500 mol % | | | 29.9 | |
| 1500 mol % or more | | | 32.7 | |

EXAMPLE 7

As the starting material was used a tar-like substance at the bottom of a still obtained by vacuum distilling a heavy residue by-produced in the refining of petroleum, and having a boiling point of at least about 360° C. under normal pressure.

This tar-like substance had a chloroform insoluble content of less than 0.1 wt% and consisted of 88.4 wt% of carbon, 9.9 wt% of hydrogen and 1.5 wt% of sulfur. Its composition and molecular weight distribution are shown in Table 1-7(a).

400 g of the tar-like substance was placed in a 500 ml stainless steel reactor and was subjected to the thermal decomposition polycondensation reaction at 430° C. for 2.25 hours while the nitrogen gas was being blown over the liquid surface of the reaction at the rate of 2 l/min. As a result, about 49 g of the residual pitch was obtained which contained about 60% of the optically anisotropic phase and had a softening point of 260° C.

Next, 40 g of this pitch was settled at 380° C. for 2 hours in the nitrogen atmosphere. After cooled, the pitch was withdrawn by destroying the glass vessel and separated into the upper layer and the lower layer in the same way as in Example 1. About 23 g of the lower layer pitch was obtained.

This pitch scarcely contained the optically isotropic pitch and had a softening point of 273° C. Its molecular weight distribution is shown in Table 1-7(b).

TABLE 1-7

(Example 7)

| | proportion wt % | fa | number-average molecular weight | maximum molecular weight |
|---|---|---|---|---|
| (a) Tar composition and properties | | | | |
| saturated components | 45.4 | — | 460 | |
| aromatic oil fraction | 39.7 | 0.75 | 390 | 660 |
| resin fraction | 14.4 | 0.76 | 520 | 1,400 |
| asphaltene fraction | 0.6 | — | — | — |
| (b) Molecular weight distribution of optically anisotropic pitch | | | | |
| number-average molecular weight | | | 1,100 | |
| maximum molecular weight | | | 19,000 | |
| molecular weight up to 600 mol % | | | 42.5 | |

TABLE 1-7-continued (Example 7)

| | |
|---|---|
| 600–1500 mol % | 28.9 |
| 1600 mol % or more | 28.6 |

What is claimed is:

1. A process for producing a homogeneous, optically anisotropic carbonaceous pitch having a low softening point used for the production of a carbon material comprising subjecting a starting material of heavy tarlike or pitch-like substance to thermal decomposition polycondensation, wherein the starting material is a mixture of compounds containing substantially no chloroform insolubles but containing components having a boiling point of at least 540° C. as principal components and consisting principally of carbon and hydrogen; the starting material containing a n-heptane soluble component having an aromatic oil fraction and a resin fraction as principle components; the aromatic oil fraction and resin fraction having a aromatic carbon fraction fa of at least 0.7, a number-average molecular weight of up to 1,000 and a maximum molecular weight of up to 2,000.

2. The process as defined in claim 1 further comprising the steps of:

subjecting the starting material to the thermal decomposition polycondensation reaction until an optically anisotropic phase in an amount from 20% to 70% is formed in the resulting pitch;

maintaining the resulting pitch at a temperature within the range of from 350° C. to 400° C. under settling or decanting conditions so that a portion containing a greater proportion of the optically anisotropic phase having a greater specific gravity is deposited in the lower layer; and separating the lower layer containing the greater proportion of the optically anisotropic phase from the upper layer.

3. The process as defined in claim 1 or 2 wherein the thermal decomposition polycondensation reaction is carried out at a temperature within the range of 380° C. to 460° C.

4. The process as defined in claim 2 further comprising subjecting the lower layer containing a greater proportion of the optically anisotropic phase to a second thermal decomposition polycondensation reaction until it contains at least 90% of the optically anisotropic phase.

5. The process as defined in claim 4 wherein the first and second thermal decomposition polycondensation reactions are carried out at a temperature of at least 380° C.

6. The process as defined in claim 5 wherein the first thermal decomposition polycondensation reaction is carried out at a temperature within the range of 400° C. to 440° C.

7. The process as defined in claim 5 wherein the separated lower layer is kept at a temperature within the range of 360° C. to 380° C. until the optically anisotropic phase accounts for from about 70% to about 90% of the pitch.

8. The process as defined in claim 5 wherein the second thermal decomposition polycondensation is carried out at a temperature within the range of from 390° C. to 440° C.

9. The process as defined in claim 1, 2 or 4 wherein the starting material has a n-heptane insoluble content of up to 1 wt%.

10. The process as defined in claim 1, 2 or 4 wherein the starting material contains an n-heptane insoluble content having an asphalten fraction as a principle component.

11. The process as defined in claim 10 wherein the starting material has a component having a boiling point within the range of from 360° C. to 540° C.

12. The process as defined in claim 11 wherein the asphaltene fraction has an aromatic carbon fraction fa of at least 0.7, a number-average molecular weight of up to 1,500 and a maximum molecular weight of up to 4,000.

13. The process as defined in claim 12 wherein the aromatic oil, resin and asphaltene fractions have a fa of at least 0.75.

14. The process as defined in claim 10 wherein the aromatic oil, resin and asphaltene fractions have a number-average molecular weight within the range of from 250 to 900 and the number-average molecular weight of the asphalten fraction does not exceed twice that of the resin fraction.

15. The process as defined in claim 1, 2 or 4 wherein the optically anisotropic carbonaceous pitch has a softening point within the range of from 230° C. to 320° C. and the optically anisotropic phase accounts for from 90% to 100% of the pitch.

16. The process as defined in claim 1, 2 or 4 wherein the starting material contains components having a boiling point within the range of from 360° C. to 540° C.

17. The process as defined in claim 16 wherein the optically anisotropic carbonaceous pitch has a softening point within the range of from 230° C. to 320° C. and the optically anisotropic phase accounts for from 90% to 100% of the pitch.

18. The process as defined in claim 16 wherein the aromatic oil and resin fractions have a fa of at least 0.75.

19. The process as defined in claim 18 wherein the aromatic oil and resin fractions have a number-average molecular weight of up to 900 and a maximum molecular weight of up to 1,500.

20. The process defined in claim 19 wherein the aromatic oil and resin fractions have a number-average molecular weight within the range from 250 to 900 and the number-average molecular weight of the resin fraction does not exceed twice that of the aromatic oil fraction.

21. The process as defined in claim 16 wherein the aromatic oil and resin fractions have a number-average molecular weight of up to 900 and a maximum molecular weight of up to 1,500.

22. The process as defined in claim 21 wherein the aromatic oil and resin fractions have a number-average molecular weight within the range of from 250 to 900 and the number-average molecular weight of the resin fraction does not exceed twice that of the aromatic oil fraction.

23. The process as defined in claim 16 wherein the thermal decomposition polycondensation reaction is carried out at a temperature within the range of 380° C. to 460° C.

* * * * *

UNITED STATES PATENT AND TRADEMARK OFFICE

CERTIFICATE OF CORRECTION

PATENT NO. : 4601813

DATED : July 22, 1986

INVENTOR(S) : Takayuki Izumi, et al.

It is certified that error appears in the above—identified patent and that said Letters Patent is hereby corrected as shown below:

On Page 1, Position 73, delete "Toa Wenryo Kogyo Kabushiki Kaisha, Tokyo, Japan".

On Page 1, Position 73, insert--Toa Nenryo Kogyo Kabushiki Kaisha, Tokyo, Japan--.

Signed and Sealed this

Sixteenth Day of December, 1986

*Attest:*

DONALD J. QUIGG

*Attesting Officer* *Commissioner of Patents and Trademarks*